US006212926B1

(12) United States Patent
Jenness

(10) Patent No.: US 6,212,926 B1
(45) Date of Patent: Apr. 10, 2001

(54) METHOD FOR SPIN FORMING A TUBE

(75) Inventor: Blair L. Jenness, Wayzata, MN (US)

(73) Assignee: Tandem Systems, Inc., Maple Grove, MN (US)

( * ) Notice: Subject to any disclaimer, the term of this patent is extended or adjusted under 35 U.S.C. 154(b) by 0 days.

(21) Appl. No.: 09/295,710

(22) Filed: Apr. 21, 1999

(51) Int. Cl.[7] ..... B21D 22/18
(52) U.S. Cl. ..... 72/69; 72/84
(58) Field of Search ..... 72/69, 81, 82, 72/83, 84, 370.12

(56) References Cited

U.S. PATENT DOCUMENTS

| | | |
|---|---|---|
| 691,727 | 1/1902 | McTear . |
| 729,099 | 5/1903 | Smith . |
| 840,270 | 1/1907 | Thiel . |
| 1,420,721 | 6/1922 | McNiff . |
| 1,471,952 | 10/1923 | Ford . |
| 2,026,133 | 12/1935 | Mapes . |
| 2,030,818 | 2/1936 | Harter . |
| 2,351,020 | 6/1944 | Dewey . |
| 2,388,545 | 11/1945 | Horak . |
| 2,406,059 | 8/1946 | Burch . |
| 2,408,596 | 10/1946 | Bednar et al. . |
| 2,434,737 | 1/1948 | Enghauser . |
| 2,541,065 | 2/1951 | Jabour . |
| 2,663,206 | 12/1953 | Whiting et al. . |
| 2,699,596 | 1/1955 | Aronson . |
| 2,726,561 | 12/1955 | Hill . |
| 2,900,712 | 8/1959 | Keating . |
| 3,050,023 | 8/1962 | Brown . |
| 3,380,275 | 4/1968 | McGraw, Jr. . |
| 3,496,747 | 2/1970 | Delmar et al. . |
| 3,594,894 | 7/1971 | Mayer, Jr. . |
| 3,672,317 | 6/1972 | Halling et al. . |
| 3,685,475 | 8/1972 | Banks, Jr. et al. . |
| 3,740,986 | 6/1973 | Schmid . |
| 3,779,060 | 12/1973 | Schröder . |
| 3,793,863 | 2/1974 | Groppini . |
| 3,815,395 | 6/1974 | Sass . |
| 3,823,591 | 7/1974 | Schröder et al. . |
| 3,846,886 | 11/1974 | Schröder et al. . |
| 3,874,209 | 4/1975 | Maiorino . |
| 3,889,835 | 6/1975 | Avant et al. . |
| 3,926,025 | 12/1975 | Schröder et al. . |
| 3,962,896 | 6/1976 | Bichel . |

(List continued on next page.)

FOREIGN PATENT DOCUMENTS

| | | | |
|---|---|---|---|
| 537094 | | 10/1931 | (DE) . |
| 081 700 | | 6/1983 | (EP) . |
| 119 141 | | 9/1984 | (EP) . |
| 0774308A1 | | 5/1997 | (EP) . |
| 2 465 532 | | 3/1981 | (FR) . |
| 2 481 237 | | 10/1981 | (FR) . |
| 58-55131 | * | 4/1983 | (JP) ..... 72/83 |
| 1085657 | | 4/1984 | (SU) . |
| 1423221 | | 9/1988 | (SU) . |

OTHER PUBLICATIONS

"ASE Model AS 23.30–CNC High Performance Machines for Endclosing and Endforming", *Autospin, Inc.*, 2 pg. brochure (Date unknown).

(List continued on next page.)

*Primary Examiner*—Lowell A. Larson
(74) *Attorney, Agent, or Firm*—Merchant & Gould P.C.

(57) ABSTRACT

The present disclosure relates to a method for forming an end portion of a tube. The method includes rotating the tube about a longitudinal axis, heating the end portion of the tube, and forming the end portion of the tube by reciprocating a forming member along a succession of curved forming paths. Each curved forming path is tangent to and curves away from a corresponding one of a succession of angularly spaced apart, substantially straight reference lines. A forming reduction is provided between each curved forming path and its corresponding one of the reference lines.

16 Claims, 5 Drawing Sheets

U.S. PATENT DOCUMENTS

| | | | | |
|---|---|---|---|---|
| 3,964,412 | | 6/1976 | Kitsuda . | |
| 4,018,072 | | 4/1977 | Davis . | |
| 4,023,696 | | 5/1977 | Anagnostidis . | |
| 4,036,044 | * | 7/1977 | Yoshimura | 72/83 |
| 4,074,106 | | 2/1978 | Nee . | |
| 4,117,704 | * | 10/1978 | Nakache et al. | 72/83 |
| 4,118,846 | | 10/1978 | Korte . | |
| 4,157,779 | | 6/1979 | Ishii et al. . | |
| 4,238,944 | | 12/1980 | Duffy et al. . | |
| 4,320,848 | | 3/1982 | Dye et al. . | |
| 4,361,360 | | 11/1982 | Kuether . | |
| 4,383,556 | | 5/1983 | Evgenievich et al. . | |
| 4,418,557 | | 12/1983 | Halene . | |
| 4,441,354 | | 4/1984 | Bodega . | |
| 4,502,310 | | 3/1985 | Gnutov et al. . | |
| 4,554,810 | | 11/1985 | Jurus . | |
| 4,711,110 | | 12/1987 | Castricum . | |
| 4,760,725 | | 8/1988 | Halasz . | |
| 4,838,064 | | 6/1989 | Päss . | |
| 5,085,131 | | 2/1992 | Barrett et al. . | |
| 5,152,452 | | 10/1992 | Fendel . | |
| 5,235,837 | | 8/1993 | Werner . | |
| 5,598,729 | | 2/1997 | Hoffmann et al. . | |

OTHER PUBLICATIONS

"DW 326 CNC", *Autospin, Inc.*, 1 pg. brochure (Date unknown).

"Heavy Duty Spinning Machine PNC 75R", *Autospin, Inc.*, 1 pg. brochure (Date unknown).

"Machine Series for Forming Profiles V–Belt Pulleys for Drive Engineering", *Autospin, Inc.*, trifold brochure (Sep., 1993).

"Partners for Metal Working", *Autospin, Inc.*, 4 pg. brochure (Date unknown).

"PNC Spinning, Shear Forming and Necking–in Machines", *Autospin, Inc.*, 4 pg. brochure (Date unknown).

Runge, M., "Spinning and Flow Forming: Spinning and Flow Forming Technology, Product Design, Equipment, Control Systems", *Liefeld GmbH*, pp. 5–70 (1994).

"Silencer Production", *Autospin, Inc.*, trifold brochure (Sep. 1988).

* cited by examiner

METHOD FOR SPIN FORMING A TUBE

FIELD OF THE INVENTION

The present invention relates generally to forming techniques. More particularly, the present invention relates to spin forming techniques for shaping metallic tubes.

BACKGROUND OF THE INVENTION

Spin forming techniques are used to manufacture tanks, drums and other vessels. For example, spin forming techniques are used to manufacture vessels ranging in size from fire extinguishers to heads for concrete truck drums. Spin forming techniques commonly include rotating a cylindrical tube about its longitudinal axis, while concurrently heating an end portion of the tube. The tube is formed by applying pressure to the heated end portion to either constrict or expand the end portion of the tube. In this regard, U.S. Pat. No. 2,408,596 (Bednar et al.) discloses a method for forming cylindrical ends by torch heating, rotating, and applying pressure to a cylindrical work piece. Pressure is applied by a tool moving in arcuate paths that curve toward a desired contour of the work piece. Similarly, U.S. Pat. No. 5,235,837 (Werner) discloses an apparatus for producing thin-walled cylindrical pressure vessels or tanks through metal spinning operations. A cylindrical work tube is rotated about its longitudinal axis, and the end of the work tube is heated by heating torches. Forming rollers are moved along a plurality of arcuate stroking paths to shape the end of the work tube. The arcuate stroking paths curve toward a desired final shape of the work tube.

U.S. Pat. No. 5,598,729 (Hoffmann et al.) discloses another method for spin forming a metallic tube. The metallic tube is rotated about its longitudinal axis, and inductive heating elements are used to heat an end portion of the tube. Forming rollers are used to form the heated end portion of the tube. The forming rollers are moved along a succession of angularly spaced apart, substantially straight forming passes.

SUMMARY OF THE INVENTION

One aspect of the present invention relates to a method for forming an end portion of a tube. The method includes rotating the tube about a longitudinal axis, heating the end portion of the tube, and forming the end portion of the tube by reciprocating a forming member along a succession of curved forming passes. Each curved forming path is tangent to a corresponding one of a succession of angularly spaced apart, substantially straight reference lines. A forming reduction is provided between each curved forming path and its corresponding one of the reference lines.

Another aspect of the present invention relates to a method for constricting an end portion of a tube. The method includes rotating the tube about a longitudinal axis, heating the end portion of the tube and constricting the end portion of the tube by reciprocating a forming member along a succession of curved forming passes. Preferably, at least some of the curved forming paths curve away from the longitudinal axis of the tube.

A further aspect of the present invention relates to a method for forming an end portion of a tube from an initial shape to a desired final shape. The method includes rotating tube about a longitudinal axis, heating the end portion of the tube, and forming the end portion of the tube by reciprocating a forming member along a succession of curved forming paths. Preferably, at least some of the curved forming paths curve away from the desired final shape.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several aspects of the invention and together with the description, serve to explain the principles of the invention. A brief description of the drawings is as follows.

DETAILED DESCRIPTION OF THE PREFERRED EMBODIMENT

Reference will now be made in detail to exemplary aspects of the present invention that are illustrated in the accompanying drawings. Wherever possible, these same reference numbers will be used throughout the drawings to refer to the same or like parts.

FIGS. 1–6 schematically illustrate a method in accordance with the principles of the present invention for forming an end portion of a cylindrical tube 20. For ease and clarity of explanation, only five separate forming paths have been illustrated. However, it will be appreciated that in actual practice, multiple intermediate forming paths will be made between the five representative paths depicted in the figures. Consequently, many more than five paths would generally be used to form a particular cylindrical tube into a desired shape. Additionally, for ease of explanation, the curvatures of the forming paths have been greatly exaggerated.

Figure 1:
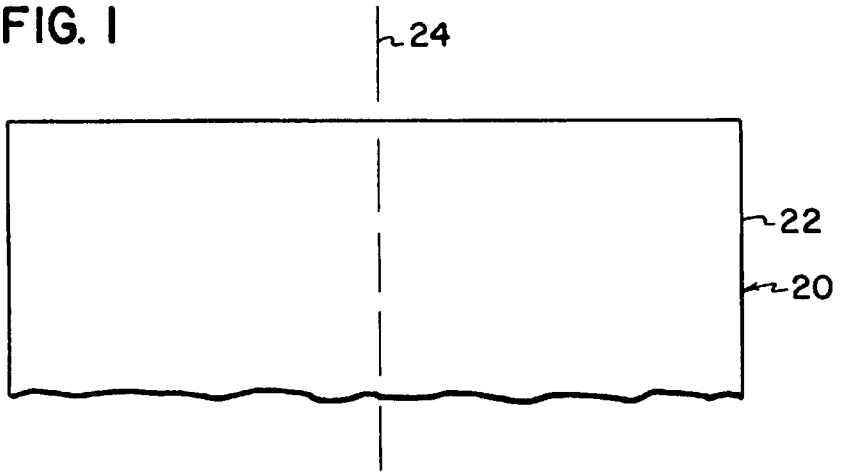
FIGS. 1–6 schematically show a succession of curved forming paths suitable for forming an end portion of a tube in a manner consistent with the principles of the present invention.

FIG. 1 illustrates an end portion 22 of the cylindrical tube 20 prior to forming. The tube 20 extends along a central longitudinal axis 24. Preferably, the tube 20 is made of a metal material, and the end portion 22 of the tube 20 is inductively heated prior to and during the forming steps of FIGS. 2–6. U.S. Pat. No. 5,598,729 to Hoffmann et al., which is hereby incorporated by references, discloses exemplary techniques that can be used to inductively heat the end portion 22 of the tube 20.

The tube 20 is preferably rotated about the longitudinal axis 24 by suitable techniques such as a lathe or a spinning table. Preferably, rollers 26 are used to form or shape the end portion 22 of the tube 20. Each roller 26 preferably has a central axis of rotation for allowing the rollers 26 to rotate as they contact the tube 20. As shown in FIGS. 2–5, the rollers 26 include a pair of rollers positioned on opposite sides of the longitudinal axis 24. However, it will be appreciated that a single roller, or more than two rollers, could also be used. Also, multiple rollers can be used along common axes of rotation, or along parallel axes of rotation.

It will be appreciated that the forming technology disclosed in the present specification can be used for tubes having various different sizes. For example, the technology can be used for tubes having diameters as small as 10–16 inches to as large as 8–10 feet. Of course, the technology can also be used for tubes having diameters other than those specifically described.

FIGS. 1–6 illustrate a method for constricting the tube 20 to form a hemispherical end cap. However, it will be appreciated that the various aspects of the present invention can be used in forming applications that either constrict or expand a tube. Additionally, the present invention is useful in forming various different types of shapes. For example, the present invention is applicable to forming exemplary end shapes such as hemispherical ends, semi-elliptical ends, conical ends, toriconical ends, torospherical ends, combined shapes, non-concentric shapes, and user specified arbitrary shapes.

As described above, FIGS. 2–6 illustrate five forming paths for constricting the end portion 22 of the tube 20 to form a ellipsoidal cap. It will be appreciated that during each of the forming paths of FIGS. 2–6, the tube 20 is continuously rotated about the longitudinal axis 24, and the end portion 22 of the tube 20 is preferably continuously heated.

In FIGS. 2–6, the rollers 26 are shown traversed along five separate forming paths. As the rollers 26 are traversed along the forming paths, the rollers 26 contact the end portion 22 of the tube and the metal of the end portion 22 of the tube 20 follows and conforms to the paths traversed by the rollers 26. Consequently, each of the forming paths shown in FIGS. 2–6 is also representative of the shape of the end portion 22 of the tube 20 after each path has been completed.

Figure 2:
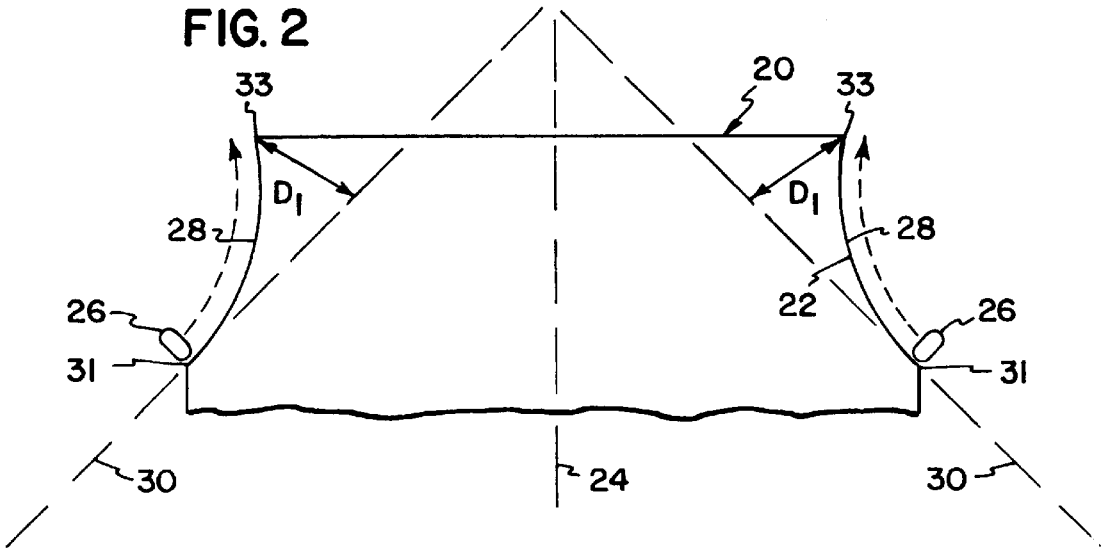

Referring now to FIG. 2, the forming rollers 26 are traversed along first curved forming paths 28. Each curved forming path 28 is tangent to a corresponding substantially straight reference line 30. The reference lines 30 are aligned at oblique angles with respect to the longitudinal axis 24 of the tube 20.

Each first curved forming path 28 curves away from its corresponding reference line such that a forming reduction is provided between each first curved forming path 28 and its corresponding reference line 30. The term "forming reduction" is intended to mean that less metal is displaced by the rollers 26 by following the first curved paths 28 than would have been displaced had the rollers 26 followed the reference lines 30. For example, as shown in FIG. 2, the first curved paths 28 provide a forming reduction distance $D_1$ relative to their corresponding reference lines 30. The forming reduction distance is measured from the end of each curved path to the location on the reference line where the tube would have ended had the roller been moved along the corresponding reference line. It has been determined that the forming reduction provides the advantage of reduced forming force requirements at the edge of the tube, and more uniform metal flow from knuckle 31 (i.e., the boundary between the portion of the tube being formed and a portion of the tube that has already been formed to a final desired shape) to tube edge 33. The forming reduction also assists in controlling the wall thickness of the end portion 22 of the tube 20.

Figure 3:
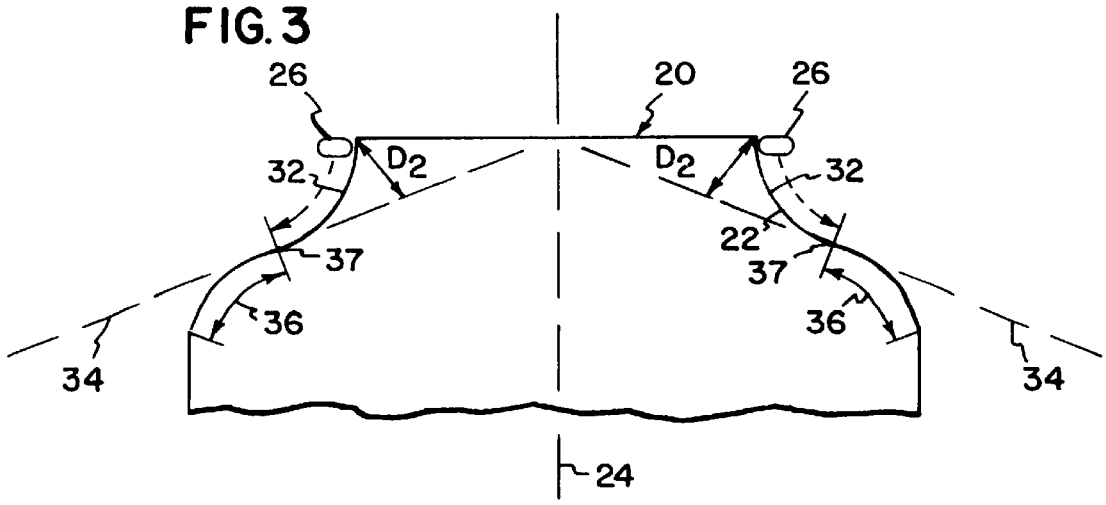

FIG. 3 illustrates the rollers 26 being moved along second curved paths 32 that are tangent to second reference lines 34. Because the tube 20 is being constricted, the second reference lines 34 are angled closer to perpendicular relative to the longitudinal axis 24 as compared to the first reference lines 30.

The second curved paths 32 are curved relative to their corresponding second reference lines 34 to provide forming reductions having distances $D_2$. Because the paths 32 start from radially inward positions and move radially outward, the forming reductions are located at the starting points of the paths 32. Preformed regions 36 are not contacted by the rollers 26 as they are moved along the second curved paths 32. The preformed regions 36 were formed to their desired final shape during subsequent paths of the rollers 26 and are separated from the forming regions by a knuckle 37. Because the preformed regions 36 have already been formed to their desired final shape and need not be modified by the rollers 26, the second curved paths 32 are preferably shorter than the first curved paths 28.

Figure 4:
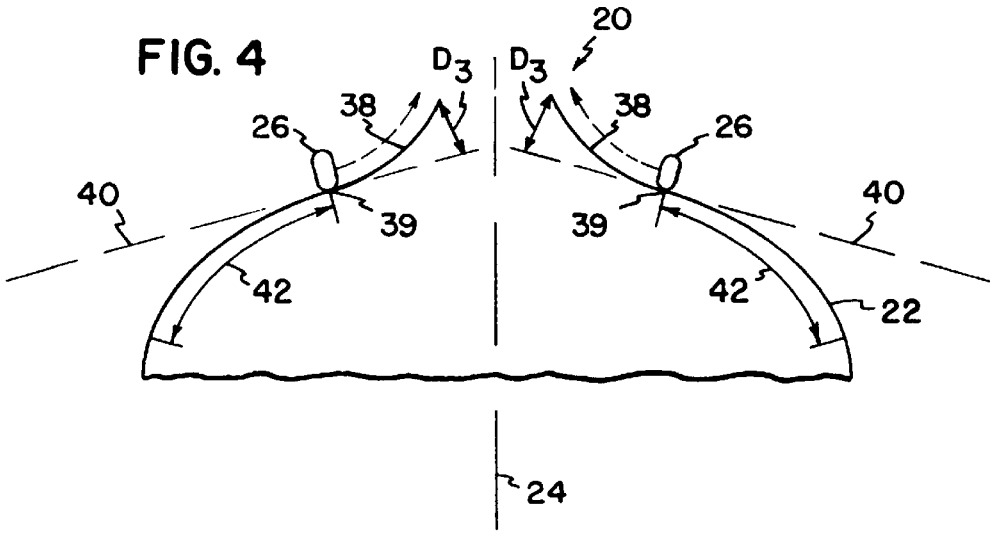

FIG. 4 illustrates the forming rollers 26 being moved along third curved paths 38 that are tangent with respect to corresponding third reference lines 40. The third reference lines 40 are closer to perpendicular relative the longitudinal axis 24 as compared to the second references lines 34. The third curved paths 38 curve away from the third reference lines 40 to provide forming reductions having distances $D_3$. Preformed regions 42 are not contacted by the third curved paths 38. A knuckle 39 forms a boundary between the curved paths 38 and the preformed regions 42. The preformed regions 42 have been previously formed to their final desired shape and are longer than the preformed regions 36 of FIG. 3. Consequently, the third curved paths 38 have shorter lengths than the second curved paths 32.

Figure 5:
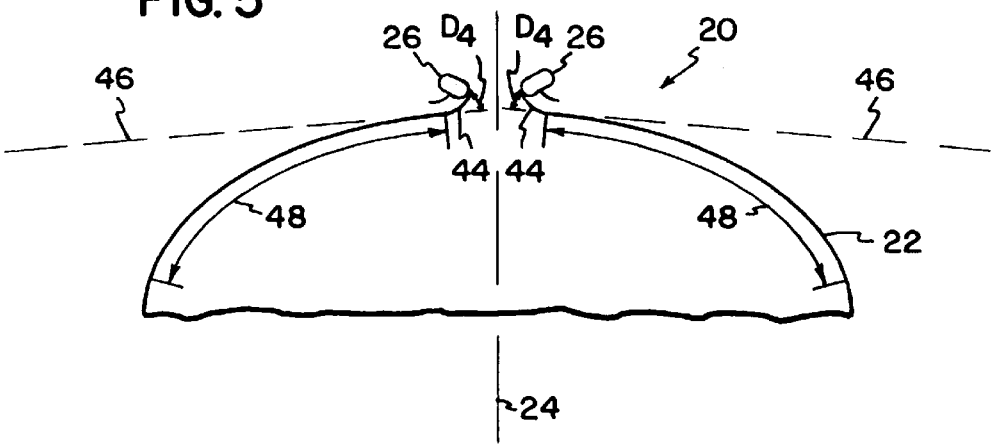

FIG. 5 illustrates the rollers 26 being moved along fourth curved paths 44 that are tangent to corresponding fourth reference lines 46. The fourth reference lines 46 are aligned closer to perpendicular relative to the longitudinal axis 24 as compared to the third reference lines 40. The fourth curved paths 44 curve relative to their corresponding reference lines 46 to provide forming reductions having distances $D_4$. The forming reductions are provided at the beginnings of the paths. As shown in FIG. 5, the end portion 22 of the tube 20 includes preformed regions 48 that are not contacted by the forming rollers 26 during the fourth curved paths 44. The preformed regions 48 have previously been formed to a final desired shape during subsequent paths of the rollers 26. Referring to FIGS. 4 and 5, the preformed regions 48 of FIG. 5 have lengths that are longer than the preformed regions 42 of FIG. 4. Consequently, the fourth curved paths 44 of FIG. 5 are shorter than the third curved paths 38 of FIG. 4.

Figure 6:
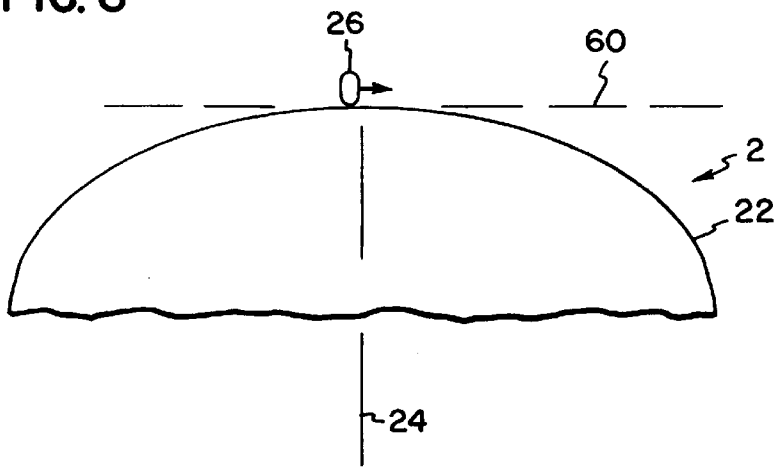

Referring now to FIG. 6, the ellipsoidal shape of the end portion 22 is completed by moving at least one of the rollers 26 along a linear path 60 that is tangent to the top of the ellipse. In this manner, the roller 26 closes the ellipse and completes the forming process.

The aspects of the present invention can be used to form complete heads having curved shapes such as hemispherical ends, semi-elliptical ends and other curved ends. The present invention can also be used to form heads that are not complete or enclosed such as conical heads. In forming a head such as a conical head, a work-out routine can be used to flatten or otherwise work out undesired curvature along the head.

In the method of FIGS. 1–6, the curved paths 28, 32, 38 and 44 comprise circular arcs. While the curved paths 28, 32, 38 and 44 have been shown as circular arcs, it will be appreciated that other types of curvatures can also be used. For example, parabolic, hyperbolic, elliptical or even random curvatures can be used.

FIGS. 1–6 show a method for constricting the end portion 22 of the tube 20. In performing the constriction, the curved paths 28, 32, 38 and 44 curve away from the longitudinal axis 24 of the tube 20 and also curve away from the desired final shape of the end portion (e.g., the ellipsoidal shape of FIG. 6). It will be appreciated that when a tube is expanded, the curved paths preferably curve towards the longitudinal axis of rotation of the tube being expanded, but still curve away from the desired final shape.

Figure 7:
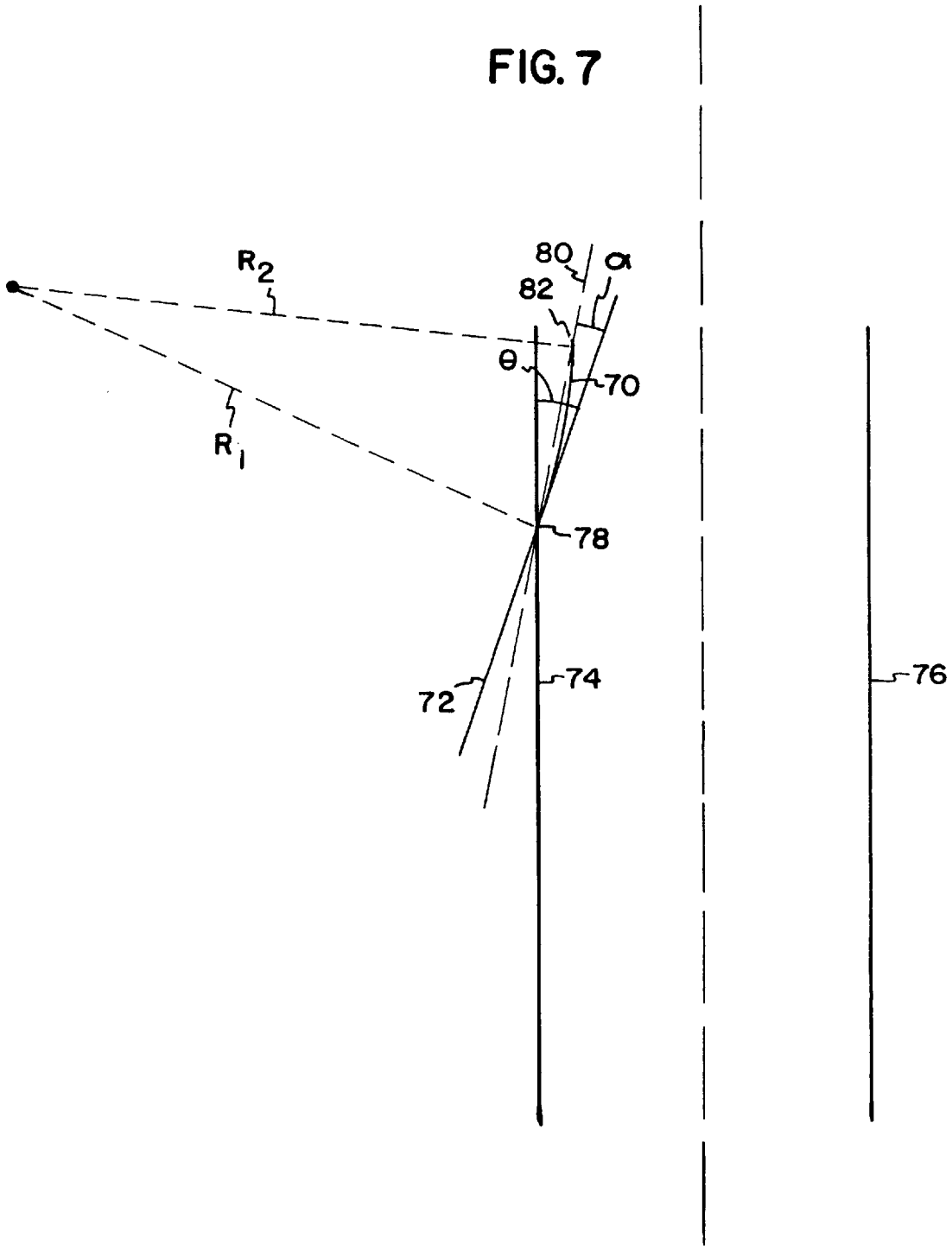
FIG. 7 schematically illustrates a curved forming path in accordance with the principles of the present invention.

FIG. 7 shows a particular curved forming path 70 in accordance with the present invention that corresponds to a reference line 72. The reference line 72 intersects a side wall 74 of a tube 76 desired to be formed at point 78. The reference line 72 forms an angle θ relative to the side wall 74. The curved path 70 is tangent to the point 78 and intersects a forming reduction line 80 at point 82. An angle α is formed between the forming reduction line 80 and the reference line 72. In certain cases, the angle α has a value that is less than 5% of the angle θ. For many applications, the angle α has a value that is about 1% or 2% of the angle θ for forming passes made early in the forming process. Due to a cumulative effect, the angle α can be as much as 50–100% of the angle θ later in the forming process. The curved path 70 is shown as a circular arc and extends between a first radius $R_1$ perpendicular to the reference line 72 at the tangent point 78, and a second radius $R_2$.

Figure 8:
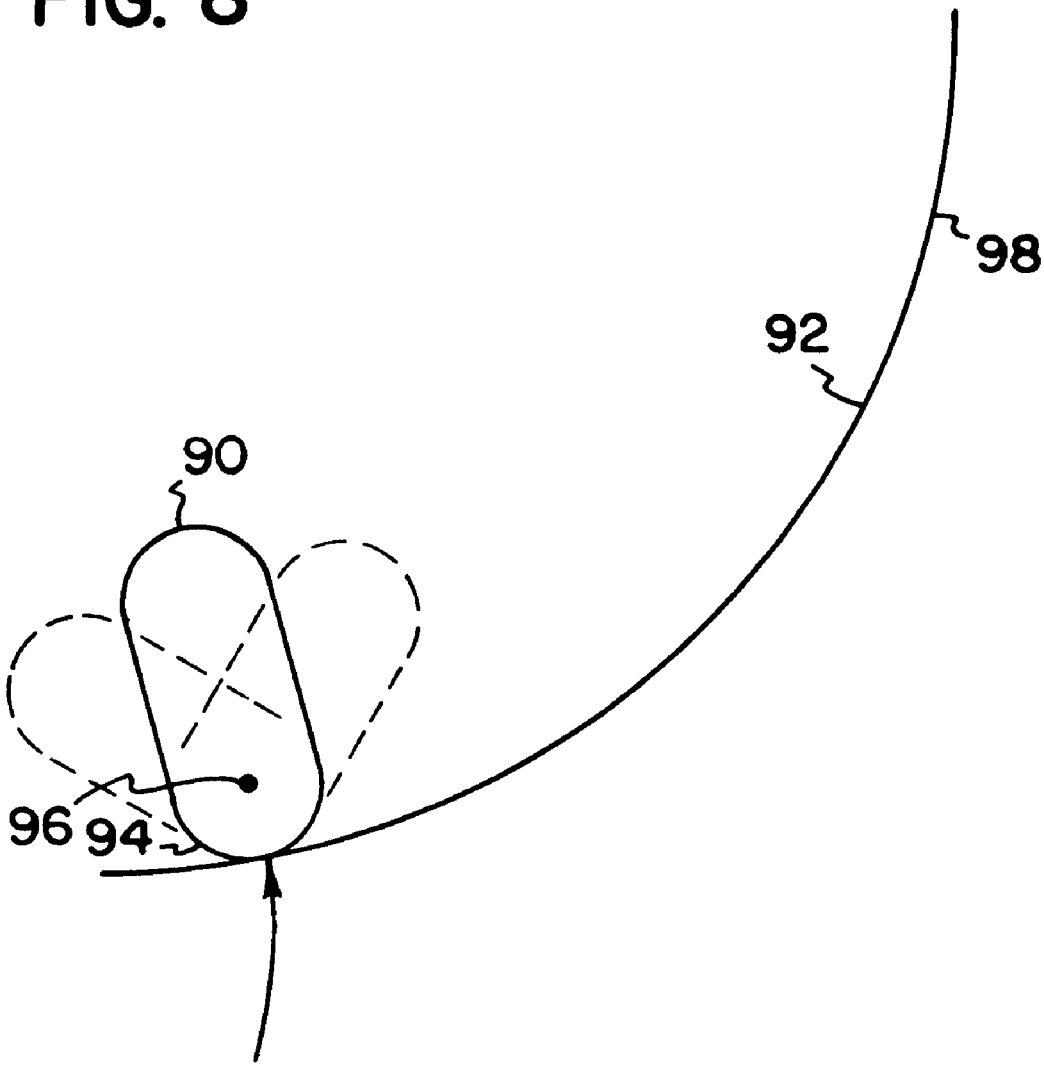
FIG. 8 schematically illustrates multiple orientations that a forming roller can be oriented in as an end portion of a tube is formed.

FIG. 8 shows a forming roller 90 that is being moved along a curved forming path 92. The forming roller 90 has a curved nose 94. The curved nose 94 is in the shape of a circular arc centered about a center point 96. During movement of the roller 90 through the curved forming path 92, the roller 90 can be pivoted about the center point 96 of the nose 94. Such rotation changes the part of the nose 94 that contacts the piece 98 being formed, but does not change the location at which the piece 98 is contacted by the roller 90. Pivoting of the roller 90 about the center point 96 of the nose 94 provides the advantage of increased mechanism flexibility providing for easier collision avoidance (e.g., between rollers and heating elements). In this manner, mechanism limitations can be overcome or circumvented without compromising forming paths, etc. The process could also be used in other applications using members having radiused noses such as grinding processes having radiused grinding wheels. Further, the processors could be used with straight or curved forming paths.

Figure 9:
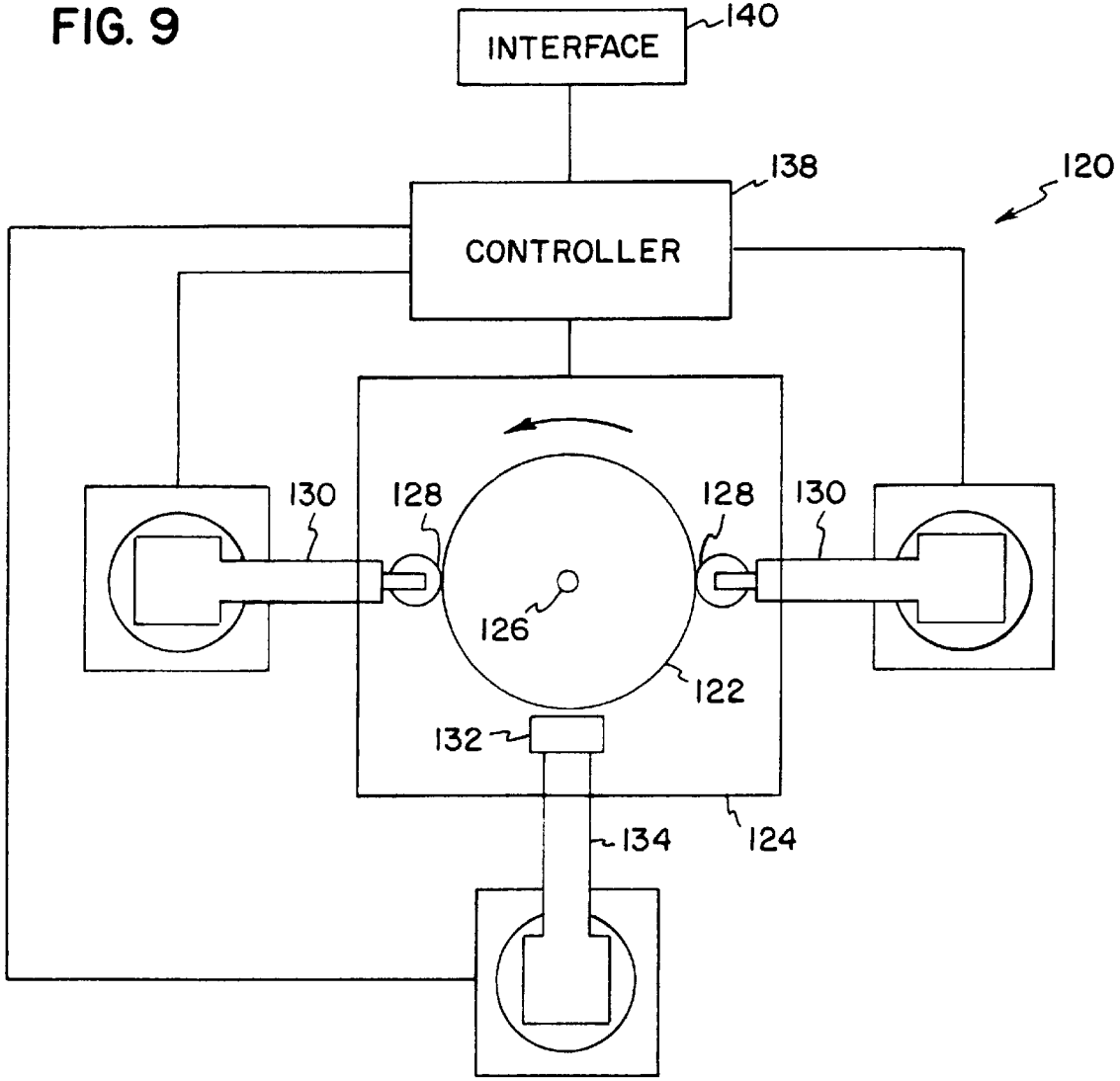
FIG. 9 schematically illustrates an apparatus suitable for forming a tube in a manner consistent with the principles of the present invention.

FIG. 9 illustrates a system 120 for forming a tube 122 in accordance with the principles of the present invention. The system includes a rotation table 124 adapted to hold the tube 122 in a vertical orientation. Of course, the tube 122 can also be rotated in a horizontal orientation. The rotation table 124 is adapted to rotate the tube 122 about a vertical axis of rotation 126. Forming rollers 128 are used to shape an end portion of the tube 122. The forming rollers 128 are preferably rotatably connected to robotic mechanisms 130. The robotic mechanisms preferably have multiple joints, articulations and pivot locations and are adapted for three-dimensionally moving the forming rollers 128. One suitable type of robotic mechanism having model S-400 is sold by Fanuc Ltd., of Japan.

The tube 122 is preferably heated by an inductive heating element 132. The inductive heating element 132 is preferably mounted on a mechanism 134 similar to the robotic mechanisms 130.

The rotation table 124 and the mechanical mechanisms 130 and 132 are preferably controlled by a central or integrated processing units such as a computer 138. A user interface 140 is used to input data into memory associated with the computer 138. The computer preferably includes a software driven processing unit for controlling or orchestrating the movement of the inductive heating elements 132 and the forming rollers 128. For example, a user can input data such as the diameter of the tube 122, and the desired final shape of the tube 122. Based on such information, the computer calculates coordinates for moving the forming rollers 128 and the inductive heating element 132 in an orchestrated manner such that the desired shape is formed.

With regard to the foregoing description, it is to be understood that changes may be made in detail, especially in matters of the construction materials employed and the shape, size and arrangement of the parts without departing from the scope of the present invention. It is intended that the specification and depicted aspects be considered exemplary only, with a true scope and spirit of the invention being indicated by the broad meaning of the following claims.

We claim:

1. A method for forming an end portion of a tube, the method comprising:

rotating the tube about a longitudinal axis;

heating the end portion of the tube; and forming the end portion of the tube by reciprocating a forming member along a succession of curved forming paths, each curved forming path being tangent to a corresponding one of a succession of angularly spaced-apart, substantially straight reference lines, each of the reference lines being tangent to a desired final formed shape of the tube, wherein a forming reduction is provided between each curved forming path and its corresponding one of the reference lines.

2. The method of claim 1, wherein the forming member engages the end portion of the tube at a forming region, and the desired final shape is progressively left behind the forming region.

3. The method of claim 1, wherein the forming member engages the end portion of the tube at a forming region, and the forming region has a length that progressively shortens as the forming roller is moved through the succession of curved forming paths.

4. The method of claim 1, wherein the end portion of the tube is constricted from an initial shape to a desired final shape, and the reference lines are progressively angled toward the longitudinal axis of the tube.

5. The method of claim 1, wherein the end portion of the tube is inductively heated prior to and during the forming process.

6. The method of claim 1, wherein the forming member comprises a roller.

7. The method of claim 6, wherein the roller has a radiused nose that curves about a nose center and that contacts the end portion of the tube during forming.

8. The method of claim 7, wherein when the roller is moved through the succession of forming paths, the roller is pivoted about the nose center.

9. The method of claim 1, wherein the reference lines are progressively angled toward a desired final shape of the tube.

10. A method for constricting an end portion of a tube, the method comprising the steps of:

rotating the tube about a longitudinal axis;

heating the end portion of the tube; and constricting the end portion of the tube by reciprocating a forming member along a succession of curved forming paths, at least some of the curved forming paths curving away from the longitudinal axis of the tube at a distal end of the end portion.

11. The method of claim 10, wherein each curved forming path is tangent to a corresponding one of a succession of angularly spaced-apart, substantially straight reference lines.

12. The method of claim 11, wherein the reference lines are progressively angled toward the longitudinal axis of the tube.

13. A method for forming an end portion of a tube from an initial shape to a desired final shape, the method comprising:

rotating the tube about a longitudinal axis;

heating the end portion of the tube; and forming the end portion of the tube by reciprocating a forming member along a succession of curved forming paths, at least some of the curved forming paths curving away from the desired final shape.

14. The method of claim 13, wherein each curved forming path is tangent to a corresponding one of a succession of angularly spaced-apart, substantially straight reference lines.

15. The method of claim 14, wherein the reference lines are progressively angled toward the desired final shape of the tube.

16. A method for using a member having a radiused nose that curves about a nose center, the method comprising:

engaging a work piece with the radiused nose, the radiused nose engaging the work piece at a first location; and pivoting the member about the nose center, wherein the member continues to contact the work piece at the first location as the member is pivoted.

* * * * *